US008689896B2

(12) United States Patent
Williams

(10) Patent No.: US 8,689,896 B2
(45) Date of Patent: Apr. 8, 2014

(54) METHODS FOR TREATING "PLUNGE ZONE" ISSUE WHEN EXTINGUISHING FULL SURFACE LIQUID TANK FIRES

(75) Inventor: Dwight P. Williams, Vidor, TX (US)

(73) Assignee: Tyco Fire & Security GmbH (CH)

( * ) Notice: Subject to any disclaimer, the term of this patent is extended or adjusted under 35 U.S.C. 154(b) by 0 days.

(21) Appl. No.: 13/507,846

(22) Filed: Aug. 2, 2012

(65) Prior Publication Data

US 2013/0037280 A1 Feb. 14, 2013

Related U.S. Application Data

(63) Continuation of application No. 11/196,882, filed on Aug. 4, 2005, now Pat. No. 8,424,612.

(51) Int. Cl.

| | |
|---|---|
| ***A62C 2/00*** | (2006.01) |
| ***A62C 3/00*** | (2006.01) |
| ***A62C 3/06*** | (2006.01) |

(52) U.S. Cl.

CPC ..... *A62C 3/065* (2013.01)
USPC ..... 169/47; 169/46; 169/66; 169/68

(58) Field of Classification Search

CPC ..... A62C 3/062; A62C 3/002; A62C 3/292
USPC ..... 169/47, 66, 68, 46
See application file for complete search history.

(56) References Cited

U.S. PATENT DOCUMENTS

| | | | | |
|---|---|---|---|---|
| 5,464,065 | A * | 11/1995 | Kaylor | 169/44 |
| 5,566,766 | A * | 10/1996 | Williams | 169/43 |
| 5,913,366 | A * | 6/1999 | Williams et al. | 169/46 |
| 8,424,612 | B2 * | 4/2013 | Williams | 169/46 |

* cited by examiner

*Primary Examiner* — Dinh Q Nguyen
(74) *Attorney, Agent, or Firm* — Sue Z. Shaper, P.C.

(57) ABSTRACT

A method for extinguishing a full surface liquid tank fire including addressing plunge zone issues, the attack including throwing at least one primary stream over a tank wall, the stream landing with a force of impact in, and defining, a plunge zone; the method including extinguishing a full surface heavy liquid tank fire by teasing the fire prior to employing a non-feathered stream to create a foam blanket.

9 Claims, 4 Drawing Sheets

METHODS FOR TREATING "PLUNGE ZONE" ISSUE WHEN EXTINGUISHING FULL SURFACE LIQUID TANK FIRES

CROSS REFERENCE TO RELATED APPLICATIONS

This application claims priority to and is a continuation of co-pending application Ser. No. 11/196,882, filed Aug. 4, 2005, entitled Methods for Treating "Plunge Zone" Issues When Extinguishing Full Surface Liquid Tank Fires, inventor Dwight P. Williams.

FIELD OF THE INVENTION

The field of the invention lies in attacking and extinguishing full surface liquid tank fires, and more particularly in treating "plunge zone" issues arising from an attack using one or more primary streams thrown over a tank wall. In particular this continuation targets "heavy liquid" tank fires.

BACKGROUND OF THE INVENTION

Introduction

The instant invention comprises an expansion of a family of inventions originating with Dwight P. Williams and Williams Fire & Hazard Control, Inc. Familiarity with certain patents and/or patent publications will be presumed for one of ordinary skill in the art. These patents and/or patent publications are: U.S. Pat. No. 5,566,766 (Empirically Determining and Using a FootPrint); U.S. Pat. No. 5,829,533 (Using FootPrint plus External Wall Cooling); U.S. Pat. No. 5,913,366 (Inner Tank Wall Cooling); WO98/03226 (Wall Cooling plus Dry Powder) and US Pub. 20030213602 (Smiley Face Treatment.)

When attacking full surface liquid tank fires in large industrial tanks by throwing foam over the tank wall, the industry has largely switched from a "surround and drown" technique to what has been called a "FootPrint" method. The "FootPrint" method stages one or more primary nozzles roughly together, and preferably upwind of the tank, in what is referred to as a six o'clock position. The nozzle(s) and application rate are selected such that the landing footprint(s) of the foam together with predicted "foam run" will, by design, carry foam to the walls of the tank and create an adequate foam blanket over the surface. Water from the foam blanket cools; the foam blanket suppresses vaporization; the foam blanket deprives the fire of access to oxygen—combustion usually requires vaporization, heat and oxygen.

It is accepted in the industry that narrowly focused streams with footprints that maximize the "local application density" of the foam will optimize the creation of a foam blanket.

In attacking and extinguishing full surface liquid tank fires, the instant inventor has determined that two significant "plunge zone" issues can arise. One can arise prior to flame collapse and the other can arise subsequent to flame collapse. Each "plunge zone" issue is usually strongly affected by the nature of the particular liquid burning. The instant invention teaches methodologies for the treatment of these "plunge zone" issues, having at least one objective of at least more cost effectively extinguishing the fire. The instant methodologies might actually be critical to extinguishing the fire, in certain circumstances, or to at least acceptably extinguishing the fire within a predetermined timeframe.

General Points—Notes and Definitions—Memory Refreshing

Industrial liquid storage tanks vary in diameter from about 100 feet to 300 feet or more. The typical wall height is 50 feet. A full surface liquid tank fire for our purposes will be deemed to be a fire involving at least 90% of the liquid surface in a tank. Normally a tank fire prior to any flame collapse would involve 100% of the liquid surface. However, a partially collapsed floating roof or the like might impede fire upon some small portion of the surface. Such a tank fire should yet be treated as full surface fire. A full surface liquid tank fire can be contrasted, for example, with a seal/rim tank fire where a floating roof limits the fire to essentially an annular ring around inside tank wall portions.

"Flame collapse" will be defined herein as the collapse of at least 50% of the flame on the surface of the tank. "Preferred flame collapse" will be deemed to refer to the collapse of at least 80% of the flame on the surface of the tank. "Partial flame collapse" will refer to the collapse of at least 20% of the flame from the surface of the tank. "Substantially full flame collapse" will indicate collapse of at least 95% of the flame on the surface; ghosting or flickering might remain.

A "primary nozzle" is a nozzle used in a primary attack on a full surface liquid tank fire to achieve flame collapse, the nozzle throwing a stream of foam over the tank wall. Primary nozzle flow rates typically vary from 1500 gpm to over 15,000 gpm. As discussed above, one or more primary nozzles are preferably staged roughly together, upwind of a tank, this location being referred to as the six o'clock position, where the combined footprint(s), application rate(s) and foam run are designed to establish and maintain an adequate foam blanket.

Because of the forward velocity of landed foam and the wind, "foam run" is typically the greatest toward the back wall of the tank, i.e. toward the twelve o'clock position. Thus, the wettest and most secure foam blanket is usually created against a back wall. This wet blanket tends to extend around toward the nine o'clock and the three o'clock positions. Flames against inner forward tank wall portions, centered around the six o'clock position, sometimes referred to as "smiley face" flames, tend to be extinguished last. Air tends to be sucked in by the fire over the tank wall at the six o'clock or forward tank wall positions when primary nozzle(s) are staged at six o'clock. This supply of fresh oxygen together with the agitation caused by the inflow of air provides a further reason why flames on inside portions of the forward tank wall may be extinguished last. An additional attack may be waged against such "smiley face" flames to improve performance.

Generally, the farther primary nozzle(s) are stationed from a tank, the better, in terms of lessening the risk of loss of equipment and personnel. Thus, primary nozzles with long ranges and/or primary nozzles adjusted to maximize range may be preferred. A straight, narrowly focused stream from a nozzle is doubly preferred, not only because it maximizes range but also because it maximizes "local application density," which is accepted as optimizing the formation of a foam blanket.

Preferably, a primary nozzle has a capacity to vary its thrown stream from a "fog" or "feathered" pattern to a narrowly focused straight stream or a non-feathered pattern. Preferably also a primary nozzle can be raised and/or lowered, to vary the height or inclination of its trajectory, and can be moved to oscillate or sweep, relatively rapidly, from side to side. A rapid oscillation would be deemed to be a sweep of about a 45 degree angle within at least 30 seconds. Preferably the sweep would take less than 20 seconds. Preferably also a primary nozzle can vary the application rate (gpm) of its thrown foam and can vary the proportioning rate of the foam concentrate. Some primary nozzles do not have all of these capabilities. Efficiency is enhanced when such preferred primary nozzles are available.

The term "foam" is used to refer to water and foam concentrate and/or already formed foam. "Foam," however, is not necessarily limited thereto. More exotic liquids than water and more exotic additives could be developed and applied. "Foam" should be understood, as used herein, to also include just water, for convenience. Thrown "foam," typically however, is water and foam concentrate which expands prior to or upon being thrown and/or at least expands upon landing.

As discussed above, foam extinguishes fire in part by blanketing the liquid surface, cutting off access to air or oxygen. (Oxygen is needed to sustain combustion.) Foam in part also extinguishes fire by means of the water in the foam evaporating, thereby removing heat. (Heat is needed to sustain combustion.) Foam also extinguishes fire by suppressing vaporization. Water carried by the foam helps to weigh the foam down, thus helping to suppress vaporization. (Frequently it is only the vapor upon the surface of a liquid that is burning. In fact, with many tank fires the liquid is cool a few inches below the burning surface. The exception is heavy liquids, such as crude, resid, asphalt and the like.)

Dry foam, foam from which the water has largely evaporated, runs less well and blankets less well. Dry foam has less weight and so it suppresses vaporization less well. Dry foam has less water and so it cools less well. Light, dry, dehydrated foam can even be a hindrance, in that the presence of a bulk of light dry foam can inhibit the approach of fresh hydrated foam. Foam "drain time," thus, is an industry defined term. It is an important parameter that is measured. "Drain time" is the time in which a foam loses 25% of its water. "Drain time" typically runs between 2 and 8 minutes for foam. Foam drain time is taken into account in planning a full surface tank fire attack. It has been discovered, in particular when working with new fuel mixtures, that drain time can be further affected by the liquid in the tank. Hydrophilic fluids drain water out of the foam down into the liquid, thereby prematurity drying out the foam. New fuel mixtures have shown significant hydrophilic tendencies. This effect is further a function of the contact area and thus can render important a minimization of agitation of the underlying liquid by fresh foam.

A "plunge zone" is the landing area of a primary stream upon the liquid surface in the tank. As the stream is moved or altered, the plunge zone is moved or altered. If the stream is broadened sufficiently, the stream is said to be a feathered stream. A feathered or broadened stream has a larger plunge zone than a non-feathered more narrowly focused stream. The impact force per unit area of a narrowly focused stream is greater than the impact force per unit area of a feathered stream, given the same application rate.

Application rate refers to the application rate of "foam" and is usually in gpm. "Local application density" refers to the application rate per unit area of a landing zone. The terms landing area, landing zone, plunge zone, plunge zone area and footprint are sometimes used interchangeably. A narrowly focused stream, for a given application rate, maximizes "local application density." As mentioned above, maximizing "local application density" tends to optimize, it is believed, the overall effectiveness of thrown foam to form a foam blanket and to run.

"Feathering" a nozzle stream is used herein to mean at least decreasing a nozzle stream's local application density. Usually feathering a nozzle stream means increasing the landing area while maintaining the same volumetric flow rate. Feathering could be accomplished, or assisted, by lowering the application rate of the stream.

A nozzle stream landing area (alternately referred to as footprint or plunge zone or plunge zone area) is typically increased by raising the nozzle to achieve a longer higher trajectory and/or by varying the nozzle discharge angle, typically by increasing the angle.

The term "feathered stream" herein, for convenience, will refer to a stream to having a local application density of less than 0.5 gpm per square foot of landing area. A "preferred feathered stream" will have a local application density of 0.3 gpm per square foot of landing area or less. A "non-feathered stream," will be deemed to have a local application density of at least 0.5 gpm per square foot of landing area. As "preferred non-feathered stream" will have a local application density of 0.6 gpm per square foot of landing area or greater.

"Teasing" a full surface liquid tank fire is used herein to refer to landing one or more "feathered streams" over at least 60% of the surface of the fire over a period of no more than one minute.

"Diminishing," as used herein, is intended to include not only reducing but also completely reducing to zero, or stopping. I.e. the force of impact per unit area of a primary stream upon a plunge zone might be "diminished" by redirecting the stream such that there is no longer any impact, upon that original plunge zone. The impact force per unit area could also be diminished by feathering the stream such that there continues to be impact upon the original plunge zone but the force of impact is lessened per unit area, such as by spreading the force over a larger or enlarged plunge zone. "Redirecting" can achieve "diminishing" the force of impact per unit area of a primary stream upon an original plunge zone by directing the stream to another portion of the surface or by directing the stream to outside of the tank, as for instance by landing the stream upon outside tank wall portions.

"Healing" in regard to a foam blanket indicates a phenomena where a foam blanket, perhaps together with new foam, spreads over and fills in a hole or a gap in a foam blanket. The hole or gap could be in the middle of the blanket or at the edge of the blanket, such as between a blanket and a portion of a tank wall. "Healing" should be understood to generally accomplish extinguishing any flame in the hole or gap, save and except perhaps for some ghosting or flickering.

The term "heavy liquid" will be used herein to refer to a liquid with a significant amount of heavies. Crude, light crude, resid and asphalt are prime examples. (Heavy liquid as used herein will be understood to include solids at ambient temperature and pressure when they are maintained liquid in industrial storage tanks by the application of heat. For instance, asphalt and resid are normally solids but might be maintained as liquid in an industrial storage tank by the application of heat. They might be heated to 300 degrees or greater.) The identification of a heavy liquid is significant because a full surface tank fire of heavy liquid has been observed to behave distinctly. It is believed that the distinct behavior results in part from a phenomena where the lights burn off while the heavies sink. It is known that a heavy liquid full surface tank fire tends to get hot for depths of between several inches to several feet. Heat waves, as they are referred to in the industry, descend from the surface of a heavy liquid toward the bottom of the tank. The heat wave can descend at a rate of between several inches an hour to several feet an hour. Since tanks with a full surface fire tend to draw air in over a leading or front tank wall portion, in the upward direction, the downwind direction of a full surface heavy liquid fire, as a result, can tend to have the deepest heat waves.

First Plunge Zone Issue—Plunge Zone Flame Subsequent to Flame Collapse

The Problem.

In a typical attack on a full surface liquid industrial tank fire one or more coordinated streams of foam are thrown over the tank wall. The stream(s) initially appear to vanish into the fire with no apparent effect. After 10 to 40 minutes of a well planned attack, however, "flame collapse" occurs. Those of skill in the art can predict flame collapse with close to scientific accuracy.

Significant problems can remain after flame collapse. First, a concerted attack must be continued to extinguish the remaining flames and to prevent re-ignition. To the extent that the foam dries out, it can cease to help and can even inhibit, so time may be of the essence. The hydrophilic nature of the burning liquid can be a factor with respect to effective foam drain time.

Second, foam concentrate is expensive and the burning product may be expensive. (Fuels burn at approximately 6-18 inches per hour, and large tanks provide 30,0000 to 90,000+ square feet of surface area.) Simply minimizing extinguishment time can significantly reduce the costs of the loss, through reducing foam concentrate utilized and product lost, not to mention through reducing total risk to equipment, personnel and the environment. For a variety of reasons, thus, the methodologies adopted after flame collapse can be important.

Flames remaining after "flame collapse" can be a function of variety of factors. Full surface tank fires must be addressed individually. One factor is the nature of the liquid burning. High vapor pressure and/or low boiling point liquids and volatile fuels can present special behavioral issues. Minimizing the contact area of fresh foam with a significantly hydrophilic liquid might be important. Metal tank walls become hot at the burn level upward and liquid adjacent the walls is easily energized, vaporized and combusted. The foam blanket must have sufficient authority to heal over against these hot tank walls. Sacrificing the "local application density" created by narrowly focused primary stream(s) in order to address other issues can risk losing flame collapse.

With the understanding that one should take into account the above factors, the instant invention addresses the first "plunge zone" issue as follows.

The location where the thrown foam stream impacts the liquid surface defines a "plunge zone." In the plunge zone the stream plunges beneath the surface. The depths of the plunge can be a function of the force of impact per unit area, which can be a function of the narrowness and/or the focus of the stream. It has been observed that upon flame collapse, especially with newer and more volatile fuels and mixtures, a "plunge fire" or "plunge flame" can persist in the plunge zone. The impact force of the landing stream, perhaps augmented by the agitation caused by the force of landing, can inhibit a foam blanket from healing over in the plunge zone even though flame collapse is achieved. To the extent the burning liquid is significantly hydrophilic, the agitation from landing foam can increase the liquid's capacity to drain water out of the foam, rendering the new foam more quickly dehydrated, light and dry, and thus less effective to suppress combustion. A combination of factors can result in the situation where, subsequent to flame collapse, there remains a plunge flame for an unacceptably long period of time, possibly, without more, indefinitely.

Solutions.

The plunge flame may go out, of course, with a continued application of narrowly focused stream(s). The foam blanket can build up in the plunge zone notwithstanding the impact forces of a narrowly focused stream such that the "plunge," so it is believed, ceases to reach down into and disturb the underlying liquid. If or when the landing impact becomes largely absorbed by a foam blanket itself, it is believed that the blanket tends to heal over and the plunge flame becomes extinguished.

However, especially with the newer and more volatile fuel mixtures, a plunge flame can remain a significantly and unacceptably long period of time after flame collapse, even after achieving substantially full flame collapse, absent use of the more specialized techniques taught herein. The instant invention teaches specialized techniques and methodology for more effectively addressing such plunge flames. (And as an alternate although less favored embodiment, the invention teaches a technique for anticipating a plunge flame issue and adopting a strategy to lessen the risk of the plunge flame problem arising.)

Again, the timing of the application of the methodology of the instant invention requires a fact and circumstances risk assessment. Diminishing the impact forces from the application of foam to a plunge zone, such as by feathering a stream or redirecting the stream or cutting off the stream and/or reducing application rate, reduces local application density. Flame collapse can be lost. That risk is not to be taken lightly, and caution and prudence suggest something like an initial rule of thumb of maximizing foam run for, say, ten minutes after foam collapse, which period should include the time needed for extinguishing any smiley face. Preferably, the only other flames remaining when turning to address a plunge flame would be some ghosting or flickering of flames along tank walls. A sufficient foam blanket around a plunge flame preferably exists such that a foam blanket can quickly move into and heal a plunge flame zone upon the diminishing of stream impact forces per unit area on the plunge flame. If choosing to diminish impact forces by redirecting the plunge zone to a different area in the tank, such as moving the zone laterally, care should be taken not to start a new plunge fire in the new plunge zone(s), such as might occur by moving the plunge zone closer to some remaining fire in the tank.

Second Plunge Zone Issue Addressed—Initial Plunge Zone Behavior

Problem.

Observation and experience has taught the instant inventor that a fully engaged tank fire of a heavy liquid becomes violent and unruly when first hit with a narrowly focused stream of foam. In the usual case, by the time nozzles are staged and an attack is initiated, the heavy liquid of a fully engaged tank fire is very hot, over the boiling point of water, down several inches if not several feet below the surface. Indeed, heavy liquid such as asphalt and resid may have been maintained at 300 degrees or higher simply to keep the substances liquid in the tank. Until the surface temperature comes significantly down with respect to the boiling point of water, a foam blanket will have difficulty being established or maintained. The heat boils the water out of the bubbles, and the plunge force per unit area of a narrow focused stream tends to create a splatter effect, splashing burning liquid out of the tank. Further, a significant percent of the water thrown with a narrow stream plunges through the liquid surface. The water from the foam that plunges deep can boil beneath the surface, causing further agitation of the burning liquid.

Solutions.

It has been found that in a full surface heavy liquid tank fire, such as crude, resid and asphalt, prior to a customary application of a focused stream of foam, designed to maximize local application density and optimize foam blanket formation, it is advisable, indeed it may be imperative, to create a different "plunge zone." An initial "plunge zone" should be designed and created to minimize forces of impact per unit area and to maximize the removal heat from a broad portion of the surface of the fire, via water turning to steam. Application rates and local application density needed for creating and maintaining a foam blanket can be sacrificed during this period. The instant invention teaches initially "teasing" the fire with a stream or streams that have a wide plunge zone and a low local application density, typically including sweeping the wide plunge zone(s) back and forth to cover a significant percent of the burning surface. Streams that lessen the impact force per unit area lessen the plunge depth and the boiling effects created by plunge depth. It is preferable to continue teasing for a few minutes, or possibly until a partial flame collapse is achieved, in order to take the heat and anger out of the fire and to lessen the temperature of the burning surface, such that a foam blanket can subsequently be more readily established. A broad feathered landing pattern is preferably utilized at this stage, oscillating the pattern relatively rapidly across the burning surface, from left wall to right wall and back again, to cover as much of the surface as possible. The feathered stream may sweep or oscillate completely off of the burning surface for a second or two. The application rate of this feathered stream can be less than the required application rate for establishing a foam blanket, and one may reduce or eliminate the amount of foam concentrate involved.

It has been found that two to four minutes of such initial "teasing" of a 150-foot full surface crude tank fire can significantly "steam away" the intensity or anger of the fire. A significant amount of the water from the feathered stream turns into steam at the surface, not only taking heat from the fire but also blanketing the surface with steam, thereby, it is believed, inhibiting access to air. As mentioned above, a partial flame collapse can occur as a result of this initial teasing. Again, as discussed above, during this teasing period the application rate of the stream(s) can be lowered and the percent of foam concentrate proportioned into the foam can be lowered or eliminated. Subsequently, the customary narrowly focused stream(s) that maximize local application density to optimize the establishment of a foam blanket can be applied with greater effect.

SUMMARY OF THE INVENTION

The invention includes methods for extinguishing a full surface liquid tank fire comprising throwing at least one non-feathered primary stream over a tank wall, the stream landing with a force of impact in, and defining, a plunge zone; achieving flame collapse leaving a plunge flame in a plunge zone; and subsequent to flame collapse, diminishing the force of impact per unit area of a stream upon the plunge flame to that of a feathered stream or less, such that a foam blanket heals the plunge zone.

It is preferable to achieve preferred flame collapse before diminishing stream impact force per unit area upon a plunge flame and more preferable to substantially extinguish flames against inner tank wall portions, except for ghosting and flickering, prior to diminishing stream impact force per unit area on a plunge flame.

A preferred method for diminishing the force of impact per unit area of a primary stream includes enlarging a stream cross section, as by enlarging its discharge angle and/or by raising the nozzle throwing the primary stream. Further methods for diminishing stream impact force per unit area include reducing a nozzle application rate, cutting off a stream, such as at the nozzle, and/or by redirecting a stream, including to outside of the tank such as to against outside wall portions of a tank, for a period of time. Another method for diminishing a force of impact of a stream on a plunge flame includes moving the plunge zone of the stream within the tank, such as laterally.

As an alternate embodiment, partial flame collapse could be achieved, including flame collapse against back tank wall portions, followed by diminishing stream impact forces per unit area upon an initial plunge zone while moving a stream plunge zone forward in the tank, thereby extinguishing plunge zone flame prior to substantially full flame collapse.

The invention includes a method for extinguishing a full surface heavy liquid tank fire, the method comprising teasing the fire for at least a minute with a feathered stream followed by applying a non-feathered stream of foam designed for substantially blanketing the surface with foam. Preferably the fire would be teased for between 2-4 minutes or until a partial flame collapse occurred. Teasing preferably includes oscillating a feathered stream such that the feathered stream landing area oscillates or sweeps from a 3 o'clock to a 9 o'clock position, or vice versa. Preferably an oscillation or sweep can be performed within 20 seconds. The stream may be briefly swept off of the burning surface of the heavy liquid.

BRIEF DESCRIPTION OF THE DRAWINGS

A better understanding of the present invention can be obtained when the following detailed description of the preferred embodiments are considered in conjunction with the following drawings, in which.

The drawings are primarily illustrative. It would be understood that structure may have been simplified and details omitted in order to convey certain aspects of the invention. Scale may be sacrificed to clarity.

DESCRIPTION OF THE PREFERRED EMBODIMENTS (Preliminary Notes: Subsequently as used in the claims means "at least subsequently," not "only subsequently." Dry powder, to the extent available, can be used to enhance the extinguishment of any tank fire, including plunge flame issues. The problem with dry powder is the limited extent to which one can rely on its timely and adequate availability. Thus, the use of dry powder is not addressed herein. That is, no reliance is placed on the availability of dry powder.)

Figure 1:
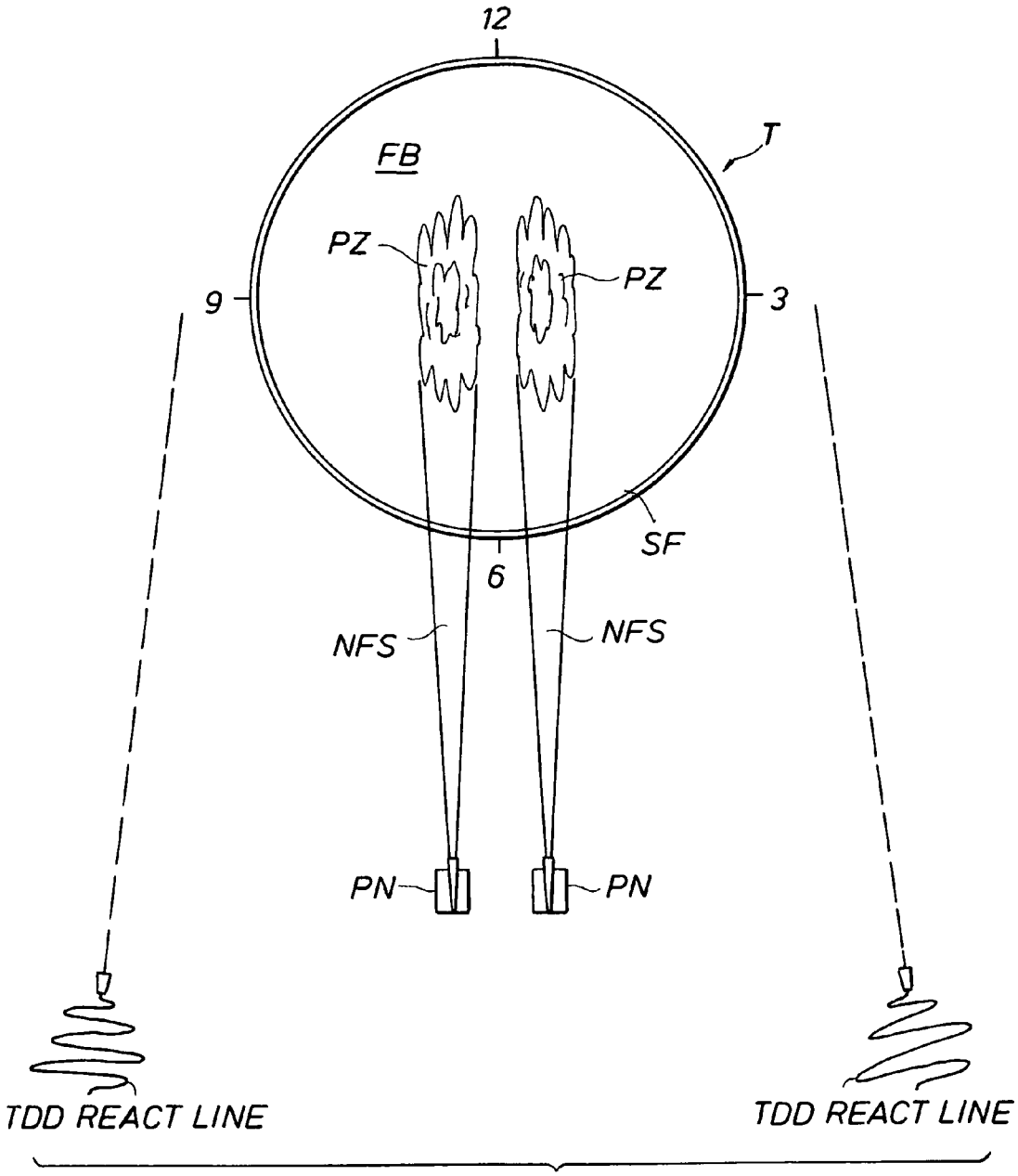
FIG. 1 illustrates an industrial storage tank having a foam blanket established over much of the surface, a plunge zone defined by two primary nozzles and a smiley face flame remaining.

FIG. 1 illustrates a petroleum storage tank T in which a foam blanket FB has been established on the surface of what had been a full surface liquid tank fire. Smiley face flames SF remain on the inside of front tank wall portions, generally in the six o'clock position and extending from the three o'clock to the nine o'clock position. Two primary nozzles PN have been staged at the general six o'clock position. They throw non-feathered streams NFS onto the surface of the liquid in tank T, landing in and defining plunge zones PZ. Foam run from the primary nozzles has created foam blanket FB.

Figure 2:
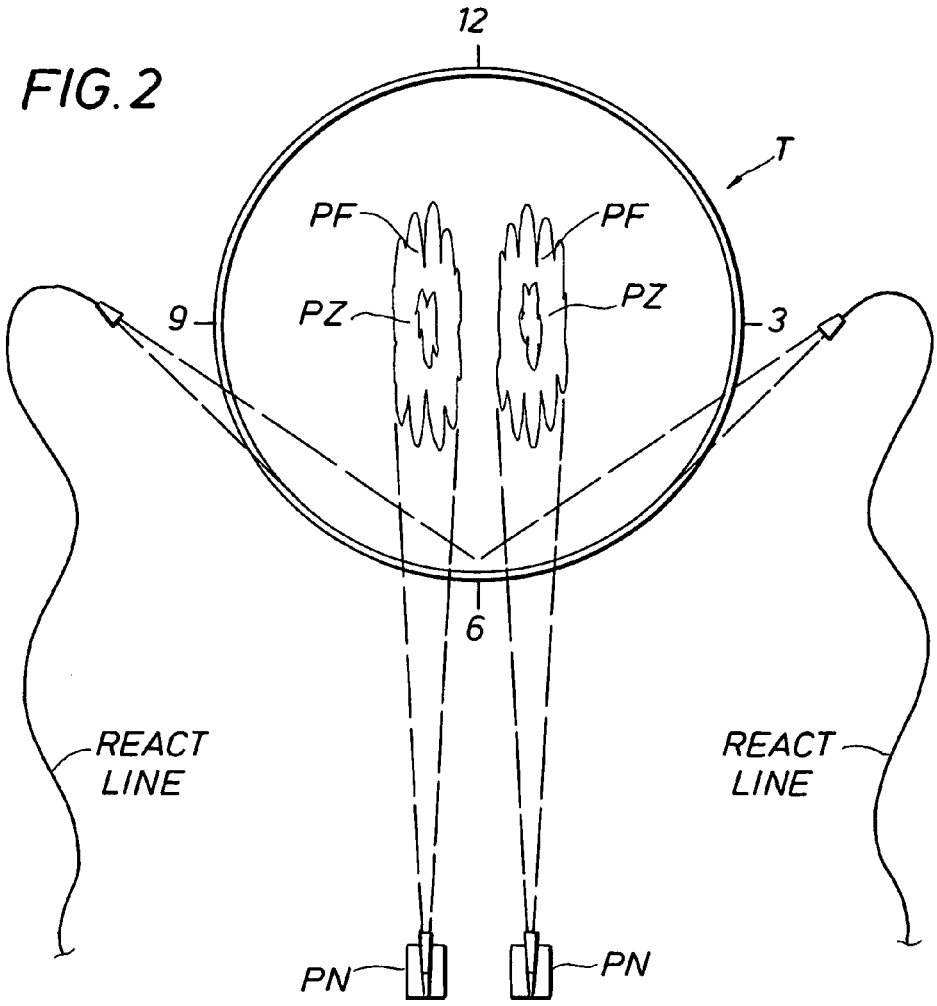
FIG. 2 illustrates extinguishment of the smiley face of FIG. 1 with a plunge flame remaining in the plunge zone.

Tank T of FIG. 1 exhibits flame collapse. In a preferred methodology react lines would be staged relatively quickly after flame collapse to attack the smiley face flames. The react lines are preferably staged at the three o'clock and the nine o'clock position. FIG. 2 illustrates two react lines deployed as above, addressing the fire in the generally three to nine o'clock position against front wall portions of the tank, thereby extinguishing the smiley face flames. FIG. 2 illustrates, however, that a plunge flame PF remains in primary nozzle plunge zones PZ.

Figure 3:
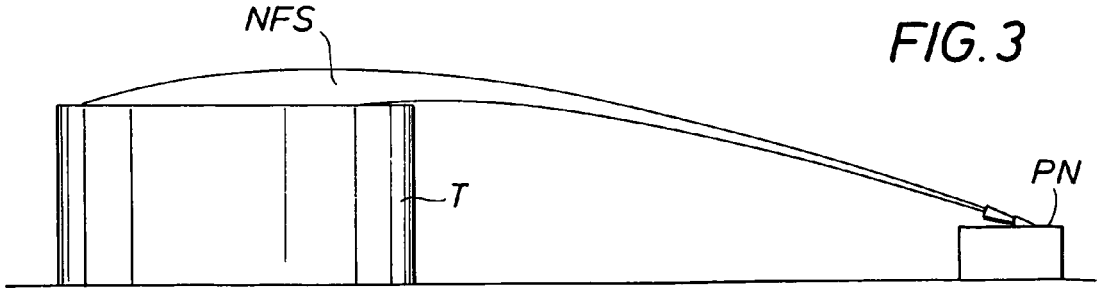
FIG. 3 illustrates a relatively straight narrowly focused stream that maximizes local application density, the approach typically utilized to optimize the creation of a foam blanket.

In a side view FIG. 3 illustrates a primary nozzle PN throwing a relatively narrowly focused non-feathered stream NFS onto the liquid surface of tank T.

Figure 4:
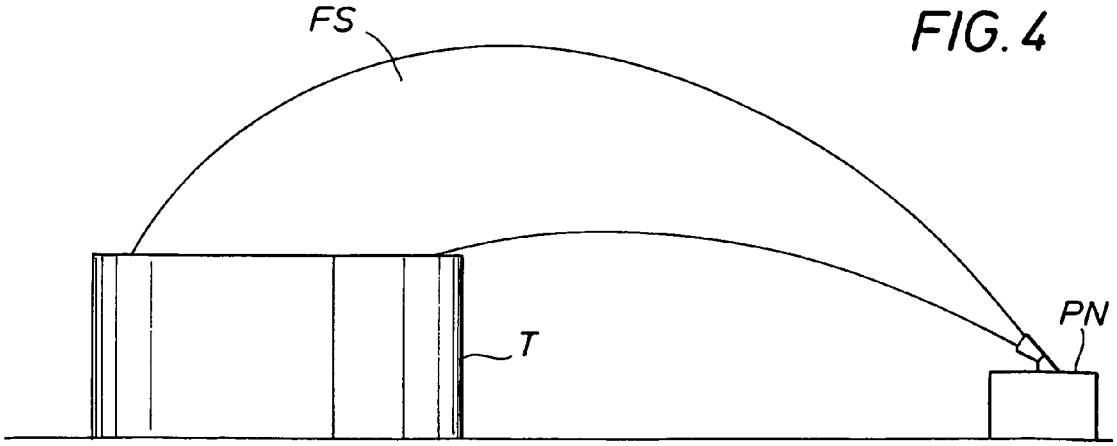
FIG. 4 illustrates a feathered stream that can be utilized to diminish impact forces per unit area.

FIG. 4, by contrast, illustrates primary nozzle PN throwing a feathered stream FS onto the liquid surface of tank T. The stream has been feathered in FIG. 4 by raising the nozzle and by changing the throwing pattern from a narrowly focused pattern to closer to a "power-cone." The feathered foam pattern tends to minimize impact forces per unit area from the stream and thus tends to minimize the plunging of the foam into and through the flammable liquid surface. In determining to switch from a narrowly focused stream of FIG. 3 to a feathered stream of FIG. 4, the operator must decide in the circumstances when and for how long to feather a stream in order to adopt a plunge flame attack plan. Many factors should be taken into account, including in particular the exact nature of the liquid burning. Although not necessary, it is preferable to extinguish smiley face flames prior to attacking plunge zone flames.

Figure 6:
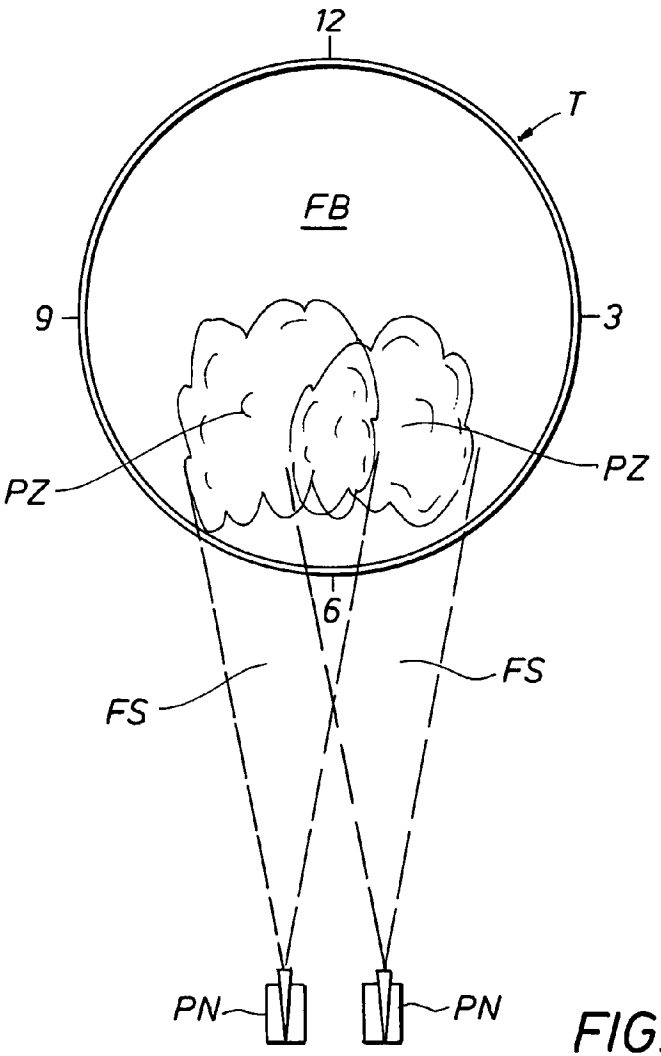
FIG. 6 illustrates a movement forward in a tank of the plunge zones of the two nozzles in FIG. 5, the foam blanket now covering the tank surface.
Figure 5:
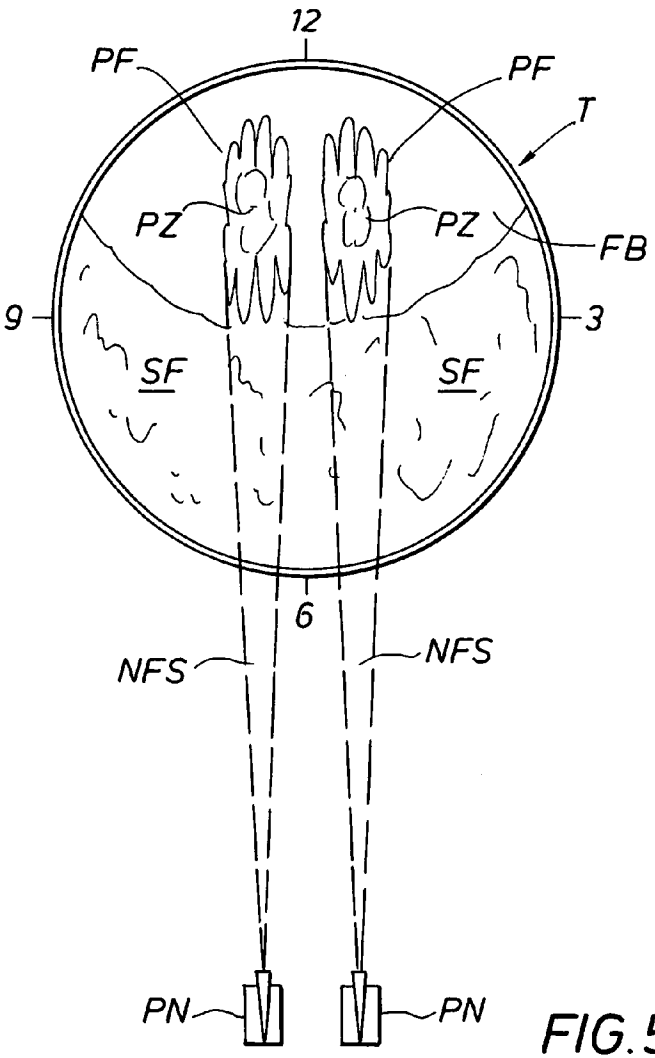
FIG. 5 illustrates a partial flame collapse with two non-focused streams and a foam blanket established against back wall portions.

FIG. 5 illustrates an alternate embodiment where two primary nozzles PN are throwing non-feathered narrowly focused streams NFS landing toward the back of tank T and creating a substantial foam blanket FB initially against back wall portions. Significant flames and/or smiley face flames SF exist in front half portions of the tank. Plunge flame PF can exist in the two plunge zones PZ. FIG. 6 illustrates a subsequent period to that of FIG. 5 where the two primary nozzles PN have changed their pattern to create more feathered streams FS, the plunge zones PZ having become larger and the plunge zones having moved toward the front of the tank. Foam blanket FB now continues to exist over back portions of the tank but also has filled in over the front portions of the tank as well. Furthermore, the prior existing plunge flame PF in the original plunge zones PZ of FIG. 5 has been healed over by foam blanket FB. Plunge flame in the plunge zones PZ of FIG. 6 have been avoided or healed over also due in part to the lessened force of impact per unit area of the more feathered streams FS in FIG. 6.

In operation, one preferred method for extinguishing a full surface liquid tank fire involves throwing at least one non-feathered primary stream over the tank wall. Preferably this non-feathered primary stream is a narrowly focused stream of foam that maximizes local application density. Whether one or more streams is required depends upon the surface area of the tank and the size or capacity of the nozzles available. The attack that includes throwing at least one non-feathered primary stream over the tank wall is an attack designed to cost effectively and efficiently blanket the burning surface with foam. The stream or streams land with a force of impact in, and define, a plunge zone. Likely, at least for a period of time, there will be a plunge flame in the plunge zone. In many cases, especially with newer fuels, flame collapse will be achieved while a plunge flame remains in the plunge zone. Subsequent to at least flame collapse, if not preferred flame collapse or substantially full flame collapse, the force of impact per unit area of at least one stream upon a plunge flame will be diminished. The diminishing can be managed by different techniques. Especially if substantially full flame collapse has been achieved, including collapse of any smiley face flame, the diminishing might preferably take the form of redirecting the landing zones or footprints of the streams laterally to the side of the tank. In such manner the full application rate of foam can continue to land on the tank surface with local application density maximized. The landing of the narrowly focused streams toward a side tank wall will tend to have a possibly beneficial effect of rotating an existing foam blanket in a tank. Another manner of diminishing the force of impact per unit area of at least one stream is to feather the stream. Feathering a stream has the additional benefit of continuing to add fresh foam to the plunge zone and to the plunge flame, just with diminished impact per unit area.

Preferably the diminishing maneuver is not begun until an adequate foam blanket has been built up around the plunge zone and plunge flame. Thus, even if the force of impact is diminished by redirecting one or more streams, an adequate foam blanket exists to heal over the plunge zone and extinguish the plunge flame, once the intense agitation of the plunge zone is lessened. Redirecting one or more streams off of the surface of the burning liquid in the tank to front wall portions of the tank has the added benefit of at least cooling outside tank wall portions.

Experiments have shown that cutting off all streams, at the nozzle, can be successful in allowing an existing foam blanket to heal over a plunge zone and extinguish a plunge flame.

A conceivable, but less favored embodiment, would diminish stream impact force per unit area by creating a foam that lands lighter. This could involve creating a foam with bigger bubbles and/or with greater expansion, and it might involve switching foam concentrates to a foam concentrate that created larger bubbles and/or had a greater expansion.

A further possible but less favored embodiment involves throwing initially at least one primary stream of foam over the tank wall and landing it in a plunge zone toward back wall portions of the tank. A partial flame collapse is first achieved against back tank wall portions. At that point the invention teaches diminishing stream impact force per unit area upon the initial plunge zone while moving a plunge zone forward in the tank. The initial plunge zone can heal over with the foam blanket formed against back tank wall portions. The plunge zone moved forward in the tank might continue to maximize local application density or might be a more feathered stream. Either way, the objective is to achieve substantially full flame collapse wherein plunge zone flames have also been extinguished. This methodology could involve a separate attack on smiley face flames, or not. A plunge zone, as it moves forward in the tank, towards the six o'clock position, would land upon pre-established foam to some extent.

Figure 7:
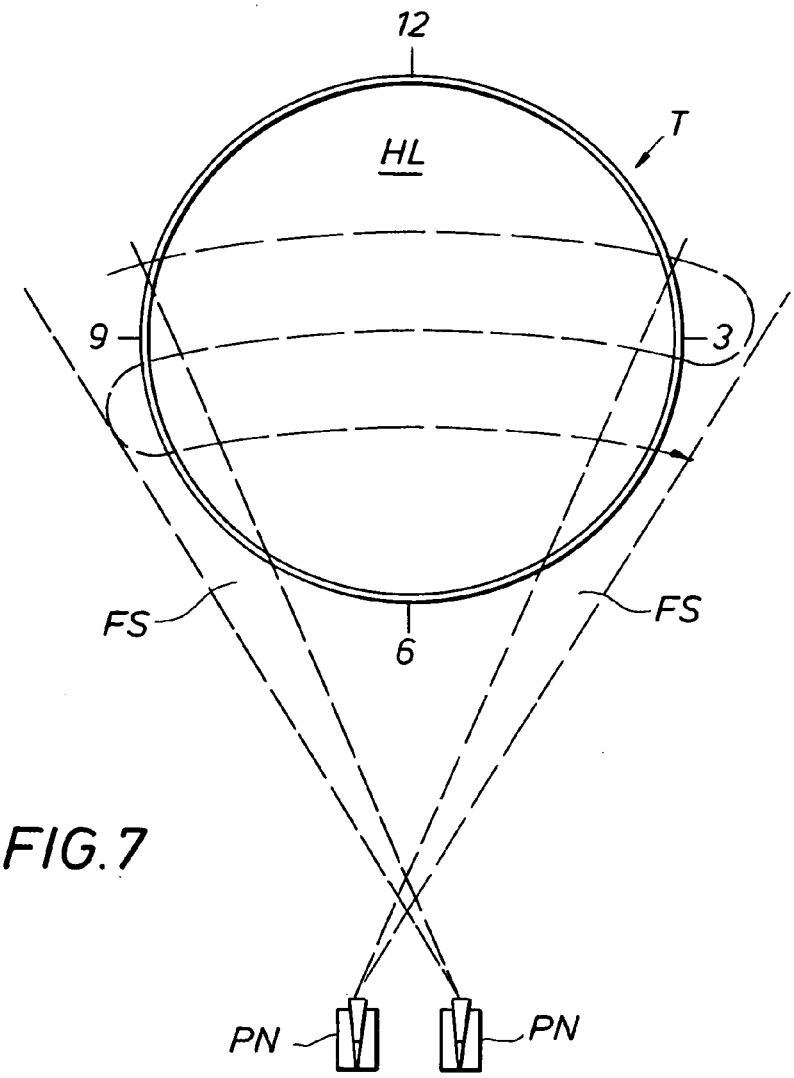
FIG. 7 illustrates the application of an oscillating feathered stream to a tank surface, the tank surface presumably involved in a full surface heavy liquid fire.
Figure 8:
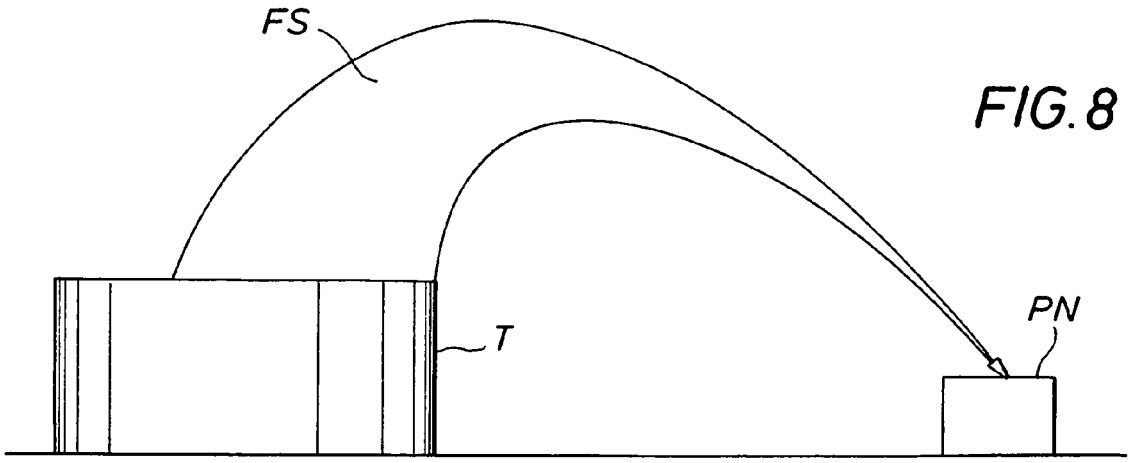
FIG. 8 illustrates a side view of the application of a wide power cone stream to the tank of FIG. 7.

FIG. 7 illustrates tank T enclosing within it heavy liquid HL. One should imagine that tank T involves a full surface fire. FIG. 7 illustrates a method of oscillating a feathered stream FS from one of two primary nozzles PN. FIG. 7 illustrates oscillating feathered stream FS to the right and back to the left and back to the right. Stream FS is oscillated off of the left and right walls of the tank momentarily. A preferred oscillation takes less than 20 seconds. If two primary nozzles will be staged to achieve the application rate necessary for establishing and maintaining a foam blanket, for the initial teasing of a full surface heavy liquid fire preferably only one nozzle would be used. Furthermore, if the nozzle application rate were 10,000 gpm, the nozzle might be cut back to 5000 gpm for the teasing operation. FIG. 8 illustrates a typical trajectory of a feathered stream as utilized in FIG. 7, the feathered stream being a wide power cone stream achieved largely by raising the trajectory of the stream from the nozzle such that the stream lands lightly. What is not illustrated in FIG. 8, but which those of skill in the art would appreciate, is that with a feathered stream there may be significant fall out of water and/or foam in the area between primary nozzle PN and tank T. Hence, with feathered streams a greater percent of the thrown liquid may not reach the tank.

The function of teasing is to take the heat or the "anger" out of the surface of the fire. The objective is not for the water of the thrown stream to sink below the surface of the burning heavy liquid but rather for the water of the thrown stream to turn into steam at the surface of the burning heavy liquid. The depth of the plunge should be minimized. The focus of teasing is cooling the surface of the liquid. It would be permissible to reduce or eliminate the foam concentrate during the teasing. Even during the teasing some product may be expelled out of the tank. The feathered stream used for teasing is preferably somewhere in between a straight stream, having an approximately zero degree divergence, and a "power cone," having an approximate 30 degree divergence angle.

In operation, the method for extinguishing a full surface heavy liquid tank fire includes, in at least one preferred embodiment, teasing the fire prior to applying a non-feathered stream of foam to the surface for substantially blanketing the surface with foam. Teasing the fire is preferably accomplished by oscillating a feathered stream from left to right across the majority of the surface of the fire, wherein one sweep or oscillation takes approximately 20 seconds. Steam from the feathered stream created at the surface of the fire takes a substantial amount of heat out of the fire and tends to blanket the surface, inhibiting access to oxygen. It has been found that when a non-feathered stream is subsequently applied to the surface of the fire a good bit of the tumultuous behavior of the burning liquid has been pacified. Preferably teasing would take place from two to four minutes. A partial flame collapse has been observed from an initial teasing alone.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof, various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

What is claimed is:

1. A method of extinguishing a full surface heavy liquid tank fire, comprising:

applying to at least a portion of the surface of the heavy liquid at least one non-feathered stream of foam, the applying designed for substantially blanketing the surface with foam; and for a period of at least one minute, at a time prior to said applying, landing one or more feathered streams upon the surface of the heavy liquid, the landing being performed such that one or more feathered streams land over at least 60% of the surface of the heavy liquid within a one minute period.

2. The method of claim 1 that includes landing said one or more feathered streams upon the surface for between two minutes to four minutes.

3. The method of claim 1 that includes said landing said one or more feathered streams upon the surface until achieving at least partial flame collapse.

4. The method of claim 1 wherein the landing of said one or more feathered streams upon the surface includes oscillating a feathered stream such that a feathered stream landing area sweeps from a 3 o'clock to a 9 o'clock position, and/or vice versa.

5. The method of claim 4 wherein an oscillating sweep is accomplished within 20 seconds.

6. The method of claim 1 that includes landing said one or more feathered streams upon the surface such that one or more feathered streams land over at least 80% of the surface of the liquid in the tank within at least 20 seconds.

7. The method of claim 1 wherein said landing said one or more feathered streams upon the surface includes landing a preferred feathered stream.

8. The method of claim 1 wherein the applying at least one non-feathered stream includes preferred non-feathered stream.

9. The method of claim 7 wherein applying at least one non-feathered stream includes applying a preferred non-feathered stream.

* * * * *